US010518138B2

(12) United States Patent
Lyon

(10) Patent No.: US 10,518,138 B2
(45) Date of Patent: Dec. 31, 2019

(54) SPORTS BALLS

(71) Applicant: MITRE SPORTS INTERNATIONAL LIMITED, London (GB)

(72) Inventor: Adam Lyon, London (GB)

( * ) Notice: Subject to any disclaimer, the term of this patent is extended or adjusted under 35 U.S.C. 154(b) by 0 days.

(21) Appl. No.: 15/537,875

(22) PCT Filed: Nov. 24, 2015

(86) PCT No.: PCT/GB2015/053587
§ 371 (c)(1),
(2) Date: Jun. 19, 2017

(87) PCT Pub. No.: WO2016/097684
PCT Pub. Date: Jun. 23, 2016

(65) Prior Publication Data

US 2017/0354851 A1 Dec. 14, 2017

(30) Foreign Application Priority Data

Dec. 19, 2014 (GB) ..... 1422806.8

(51) Int. Cl.
*A63B 41/08* (2006.01)

(52) U.S. Cl.
CPC ..... *A63B 41/08* (2013.01); *A63B 41/085* (2013.01); *A63B 2225/01* (2013.01)

(58) Field of Classification Search
CPC ..... A63B 41/08; A63B 2225/01
See application file for complete search history.

(56) References Cited

U.S. PATENT DOCUMENTS 2,325,128 A * 7/1943 Grady ..... A63B 37/00 156/213
2,579,294 A * 12/1951 Brown ..... A63B 41/08 156/145
2,843,383 A * 7/1958 Wheeler ..... A63B 39/00 473/597
3,506,265 A * 4/1970 Yugi ..... A63B 41/00 473/125
4,187,134 A * 2/1980 Svub ..... A63B 41/10 156/147
4,191,375 A * 3/1980 Uruba ..... B29C 53/76 156/170
5,542,662 A * 8/1996 Kouzai ..... A63B 41/00 473/605

(Continued)

FOREIGN PATENT DOCUMENTS

CN 1241144 A 1/2000

OTHER PUBLICATIONS

Interntional Preliminary Report on Patentability for PCT Application No. PCT/GB2015/053587, dated Jun. 20, 2017, 6 pages.

(Continued)

*Primary Examiner* — Steven B Wong
(74) *Attorney, Agent, or Firm* — P.G. Scott Born Foster Garvey PC

(57) ABSTRACT

A sports ball outer casing comprising a ball-shape frame (4) defining a plurality of openings (6, 6*a*, 6*b*) and a plurality of panels (8), each panel being secured to the frame to cover a respective one of said plurality of openings. In this construction the frame provides a 'skeleton'-like structure that can follow what would be the seam lines between panels in a conventional ball casing.

13 Claims, 3 Drawing Sheets

(56) References Cited

U.S. PATENT DOCUMENTS

| | | | | |
|---|---|---|---|---|
| 6,024,661 | A * | 2/2000 | Guenther | A63B 41/08 473/599 |
| 6,302,815 | B1 * | 10/2001 | Shishido | A63B 41/08 473/598 |
| 6,651,590 | B2 | 11/2003 | Willinger et al. | |
| 6,729,984 | B2 * | 5/2004 | Silverglate | A63B 43/00 273/157 R |
| 6,971,965 | B1 * | 12/2005 | Shishido | A63B 41/08 473/604 |
| 8,052,552 | B2 * | 11/2011 | Silverglate | A63H 5/00 446/419 |
| 8,753,235 | B1 | 6/2014 | Daniel et al. | |
| 9,161,888 | B2 * | 10/2015 | Lamar | A61J 17/007 |
| 9,162,114 | B1 * | 10/2015 | Marc | A63B 41/10 |
| 2003/0008736 | A1 * | 1/2003 | Hung | A63B 41/08 473/598 |
| 2005/0153803 | A1 * | 7/2005 | Swiszcz | A63B 41/08 473/593 |
| 2007/0238562 | A1 * | 10/2007 | Nagao | A63B 39/06 473/605 |
| 2009/0209374 | A1 * | 8/2009 | Ou | A63B 41/10 473/605 |
| 2009/0325747 | A1 * | 12/2009 | Ou | A63B 41/08 473/605 |
| 2013/0059683 | A1 * | 3/2013 | Krysiak | A63B 41/08 473/597 |
| 2014/0336021 | A1 | 11/2014 | Jones | |
| 2016/0107047 | A1 * | 4/2016 | Canobbio | A63B 43/002 473/603 |
| 2016/0263444 | A1 * | 9/2016 | Nurnberg | A63B 41/08 |
| 2017/0072270 | A1 * | 3/2017 | Shishido | A63B 41/08 |

OTHER PUBLICATIONS

Chinese Office Action, Application No. 201580074256, dated Sep. 30, 2018, 8 pages.

* cited by examiner

SPORTS BALLS

FIELD OF THE INVENTION

The invention relates to sports balls, in particular inflatable sports balls, for example soccer balls, rugby balls and netballs.

BACKGROUND

Conventional inflatable sports balls, such as soccer balls, typically have a spherical (or ovoid) outer casing and an inflatable bladder within the casing. Often, one or more intermediate layers are provided between the bladder and the casing to provide additional strength and/or cushioning. The outer casing may itself be a laminate construction for improved strength and durability. The bladder is inflated with air through a valved opening that extends from the bladder to the outer casing.

The outer casing of a conventional soccer ball is formed from a series of leather or synthetic leather (e.g. PU and PVC) panels that are joined to one another along their edges to form the enclosure within which the bladder is retained. The pressure of the inflated bladder within the casing forces the joined panels to assume the desired spherical shape. Various panel configurations are possible but the most common arrangement is a casing that includes twenty regular hexagonal panels and twelve regular pentagon shaped panels arranged in the form of a truncated icosahedron.

The panels are joined at their edges by stitching or with adhesives or by thermally bonding the panel edges to one another.

The highest quality balls tend to be hand-stitched as this tends to give tighter stronger seams, which in turn results in a ball that has good power and aerodynamic properties. Mid-range balls are often also stitched but use machine stitching, which does not tend to produce seams that are as strong as the hand-stitched balls. Lower-end practice balls often use glued seams resulting in balls that typically do not perform as well but have the advantage that they do not take up as much water as stitched seam balls when used in the wet. More recently, thermally bonded balls (in which the panel edges are bonded to one another using heat and by means of an adhesive) have become popular, which offer stronger seams than glued balls. However, thermally bonded balls do not tend to perform as well as a good hand-stitched ball, especially as the seams tend to have relatively flat profiles that are difficult to keep consistent, which can lead to poor aerodynamics.

SUMMARY OF INVENTION

A general aim of the present invention is to provide a ball constructions that can offer the seam strength and aerodynamic performance of a good hand-stitched ball, whilst minimising water uptake.

In a first aspect the invention provides a sports ball outer casing comprising:

- a ball-shape frame defining a plurality of openings; and
- a plurality of panels, each panel being secured to the frame to cover a respective one of said plurality of openings.

In this construction the frame provides a 'skeleton'-like structure that can follow what would be the seam lines between panels in a conventional ball casing. The frame can provide strength and rigidity, as well as a consistent and accurate shape along these 'seam lines' to give good power and aerodynamic stability, which may be comparable to high-end hand-stitched balls. However, by avoiding stitched seams, water uptake by the ball casing is significantly less than for a conventional stitched ball. Balls in accordance with embodiments of the invention can also be manufactured significantly quicker than a hand-stitched ball.

In some embodiments the panels are secured to the inside of the frame so that the frame is exposed on the outside of the casing between the panels. By providing the panels on the inside of the frame, the frame can more securely hold the panels in place when the ball is inflated, as the panels are pressed outwards against the frame.

The frame may take any suitable form. One possible form is a generally Y-shape cross-section, with arms of the Y providing lips against which edges of adjacent panels can locate and the leg of the Y extending inwardly between the panels. In the case where the panels are secured to the inside of the frame, the arms of the Y cross-section of the frame then extend over an outer face of the edges of the panels. Various other cross-sectional shapes can be used, including for example 'T' shape and 'I' shape.

In some embodiments, the depth of the panels is such that the panels extend inwardly of the frame, e.g. inwardly of the leg of the Y. In this way, inner portions of adjacent panel edges can directly abut one another and, preferably, be bonded to one another. In some embodiments, with appropriate selection of the panel material, these abutting edge portions of the panels can be bonded to one another directly without the need for an adhesive. This simplifies the manufacturing process.

The panels can be secured to the frame in any of a number of appropriate ways. Preferably, however, edges of the panels are bonded to the frame. In some embodiments the materials of the frame and the panels can be selected such that the panels can be bonded directly to the frame without the need for an adhesive. This simplifies the manufacturing process.

Suitable materials for the frame include polymeric materials that have suitable strength and rigidity properties, such as latex rubbers and polyurethanes for example.

As with known sports balls, in some embodiments each panel can have a multi-layer laminate structure comprising an outer shell layer and one or more inner layers. The panels may have a sandwich construction, for example, with layers formed from one or more of the following: Polyurethane Microfibre; Polyurethane; TPU Thermoplastic Polyurethane; EVA Foam; EPDM Foam; TPEN Foam; Polyester; Cotton; and Latex Rubber.

Sports ball outer casings in accordance with embodiments of the present invention may have any suitable ball shape, dependent for example on the sport for which they are intended. One common shape is spherical, for example where the casing is for a soccer ball.

Especially in the case of a spherical ball, the frame may define 32 openings, including 20 regular hexagonal openings and 12 regular pentagon shape openings, arranged in the form of a truncated icosahedron with each pentagon opening being adjacent 5 of said hexagonal openings.

In a second aspect, the invention provides a ball-shape frame for a sports ball outer casing according to the first aspect above, the frame defining a plurality of openings for receiving respective panels.

In some embodiments of this aspect, the frame is spherical and defines 32 openings, including 20 regular hexagonal openings and 12 regular pentagon shape openings, each pentagon opening being adjacent 5 of said hexagonal openings.

In a third aspect, the invention provides a sports ball comprising an outer casing according to the first aspect above and an inflatable bladder retained within the casing.

BRIEF DESCRIPTION OF THE FIGURES

An embodiment of the invention is described below by way of example with reference to the accompanying figures, in which.

DESCRIPTION OF EMBODIMENT

Figure 1:
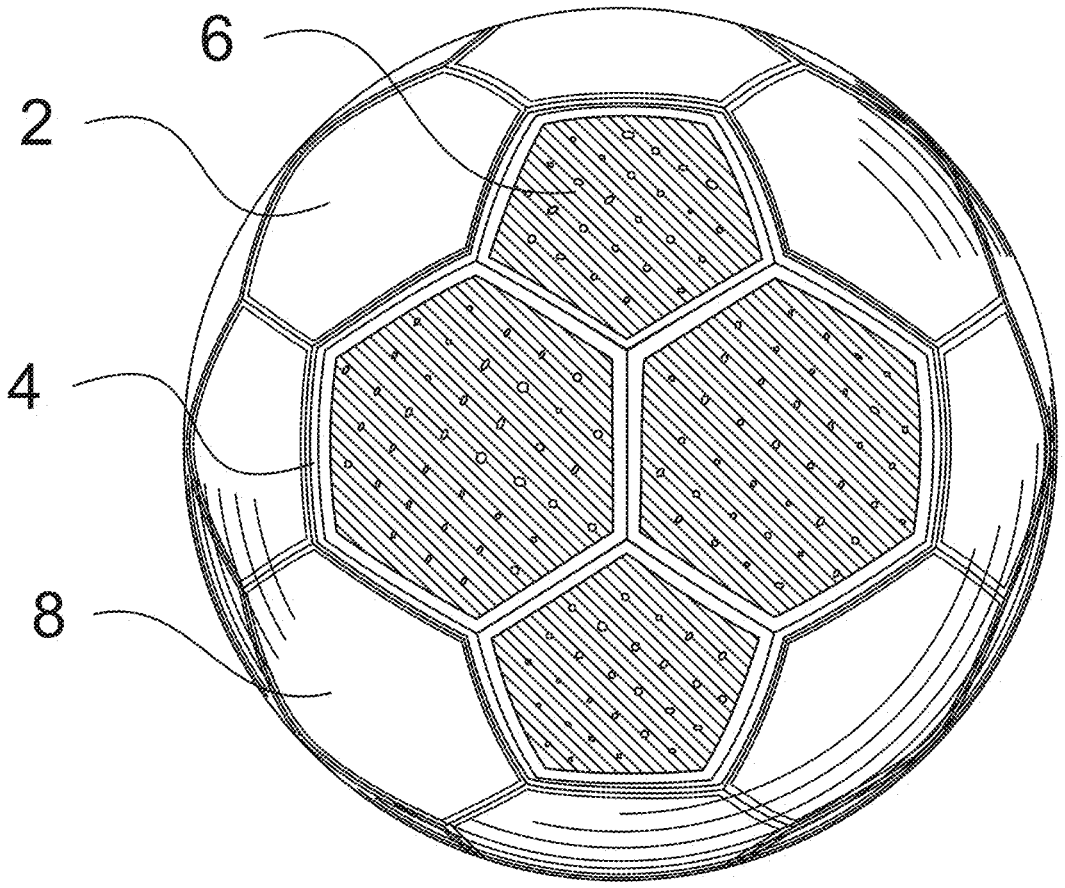
FIG. 1 shows a soccer ball having an outer casing in accordance with an embodiment of the invention.

FIG. 1 shows a soccer ball that has a spherical outer casing 2 within which there is an inflatable bladder (not shown).

Figure 2:
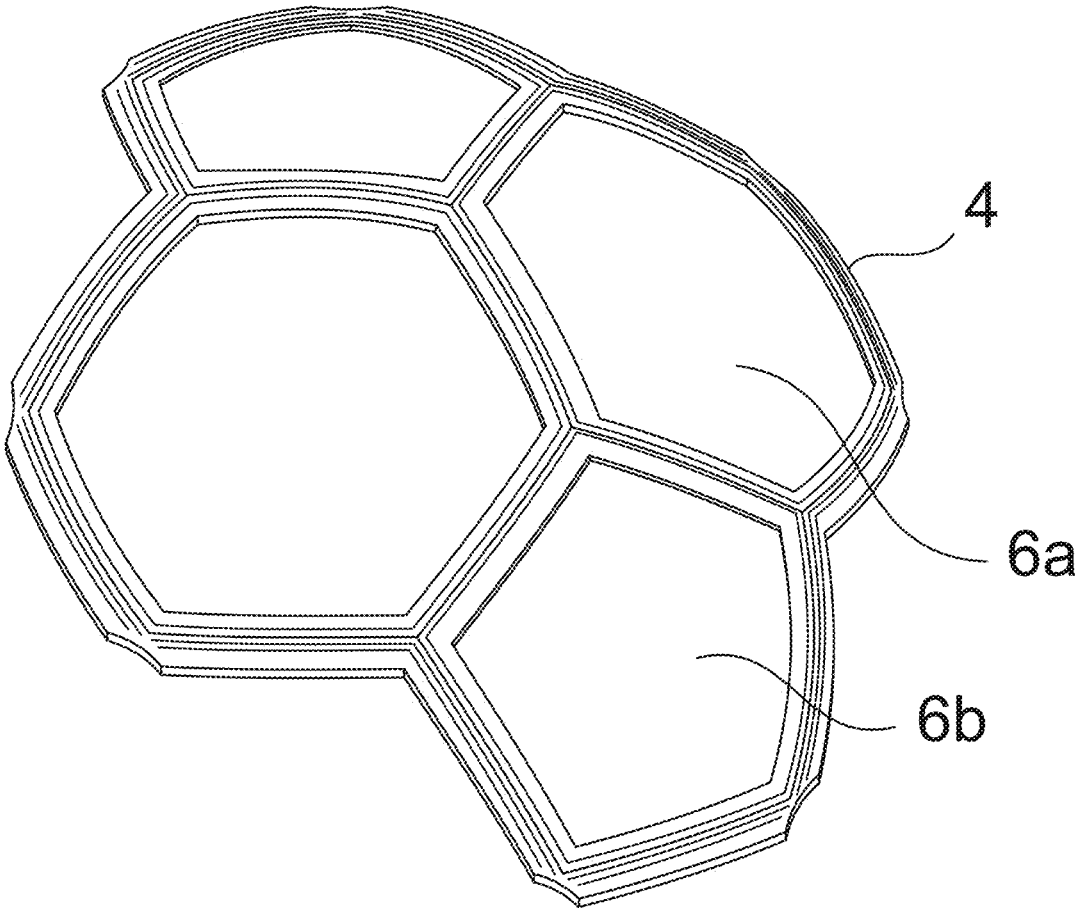
FIG. 2 shows a portion of an external skeleton frame of the outer casing of the soccer ball of FIG. 1.
Figure 3:
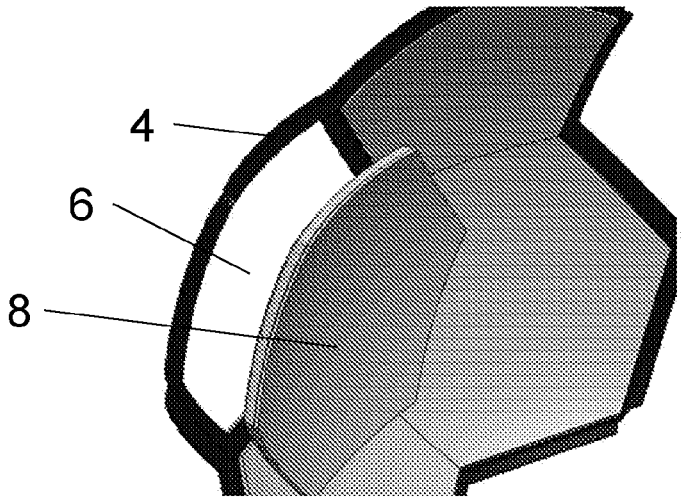
FIG. 3 shows a partial view from inside the outer casing of the soccer ball of FIG. 1 with a panel separated from the external skeleton frame.

In accordance with an embodiment of the invention, and with reference also to FIGS. 2 and 3, the outer casing 2 includes an external skeleton frame 4 having an overall spherical form. The frame 4 defines a series of openings 6 that are closed by panels 8 secured to the frame. In this example, the ball has a 32 panel construction, the frame having 20 openings 6*a* that are hexagonal in shape and 12 openings 6*b* that have a pentagon shape, arranged in the form of a truncated icosahedron. Each opening is covered by a correspondingly shaped panel 8.

Figure 4:
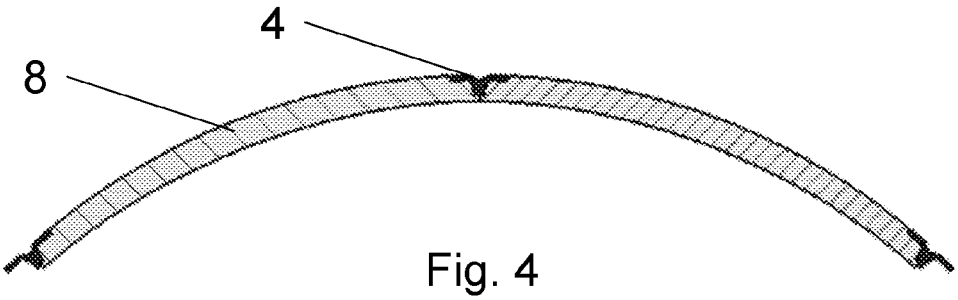
FIG. 4 shows a partial cross-section of the casing of the ball of FIG. 1.

As best seen in FIG. 4, the frame elements 4 have a generally Y-shape cross-section. This helps to give the frame the desired strength and rigidity. The panels 8 seat against the underside of the arms of the Y, with the leg of the Y extending inwardly between adjacent panel edges. However, the panel edges extend inwardly further than the frame, so that the edges of the adjacent panels also butt up against one another at inner portions. The panels are bonded to one another at these abutting inner edge portions as well as being bonded to the frame.

In order to construct the ball, the frame is moulded in two halves. Each half of the frame is placed into a respective half of a ball mould. The panels, which may be die cut and of a generally conventional sandwich construction, are then laid into the openings in the frame.

The bladder and any desired intermediate layers are then placed within one half of the mould. The bladder can be of a conventional construction, with a valved opening that is attached to one of the casing panels to be accessible from outside of the casing in the finished ball. Finally, the two halves of the frame, with inlaid panels, are brought together around in the bladder in the ball mould and the whole assembly is heated to cause the panels to bond to the frame and to one another.

Various variations and modifications to the specifically described example are possible within the scope of the invention. For example, whilst the invention has been illustrated above with an embodiment that has a frame with a generally 'Y' shape cross-section, frames with other cross-sections can be used. Other suitable cross-sections include generally 'T' shape and generally T shape cross-sections. The skilled person will also appreciate that the invention is applicable to other types of sports ball, such as rugby balls and netballs for example.

The invention claimed is:

1. A sports ball outer casing comprising:

a ball-shape frame defining a plurality of openings; and a plurality of panels, each panel being secured to the frame to cover a respective one of said plurality of openings, wherein the panels are secured to the inside of the frame so that the frame is exposed on the outside of the casing between the panels, wherein an outer face of each of the panels is exposed on the outside of the casing through its respective opening in the frame to form an outer surface of the sports ball, wherein the frame has a generally Y-shape cross-section, with arms of the Y providing lips against which edges of adjacent panels can locate and the leg of the Y extending inwardly between the panels, and wherein the depth of the panels is such that the panels extend inwardly of the leg of the Y, whereby inner portions of adjacent panel edges can directly abut one another.

2. A sports ball outer casing according to claim 1, wherein the panels are secured to the inside of the frame with the arms of the Y cross-section of the frame extending over an outer face of the edges of the panels.

3. A sports ball outer casing according to claim 1, wherein said abutting edge portions of adjacent panels are bonded to one another.

4. A sports ball outer casing according to claim 3, wherein the panel material is selected such that the abutting edge portions of the panels can be bonded to one another directly without the need for an adhesive.

5. A sports ball outer casing according to claim 1, wherein edges of the panels are bonded to the frame.

6. A sports ball outer casing according to claim 5, wherein the materials of the frame and the panels are selected such that the panels can be bonded directly to the frame without the need for an adhesive.

7. A sports ball outer casing according to claim 1, wherein the frame is formed of a polymeric material.

8. A sports ball outer casing according to claim 5, wherein the frame is formed of a latex rubber or polyurethane.

9. A sports ball outer casing according to claim 1, wherein each panel has a multi-layer laminate structure comprising an outer shell layer and one or more inner layers.

10. A sports ball outer casing according to claim 1, having a spherical shape.

11. A sports ball outer casing according to claim 10, wherein the frame defines 32 openings, including 20 regular hexagonal openings and 12 regular pentagon shape openings, each pentagon opening being adjacent 5 of said hexagonal openings.

12. A sports ball comprising:

an outer casing according to claim 1; and an inflatable bladder retained within the casing.

13. A sports ball according to claim 12, wherein the ball is a soccer ball.

* * * * *